US007090398B2

(12) United States Patent
Shibata

(10) Patent No.: US 7,090,398 B2
(45) Date of Patent: Aug. 15, 2006

(54) GAS VENTING STORAGE BAG

(75) Inventor: Yukihiko Shibata, Nagoya (JP)

(73) Assignee: Daiwa Gravure Co., Ltd., Nagoya (JP)

( * ) Notice: Subject to any disclaimer, the term of this patent is extended or adjusted under 35 U.S.C. 154(b) by 245 days.

(21) Appl. No.: 10/704,081

(22) Filed: Nov. 7, 2003

(65) Prior Publication Data

US 2004/0096128 A1 May 20, 2004

(30) Foreign Application Priority Data

Nov. 14, 2002 (JP) ..... 2002-330140

(51) Int. Cl.
*B65D 33/01* (2006.01)

(52) U.S. Cl. ..... 383/101; 383/107

(58) Field of Classification Search ..... 383/100, 383/101, 102, 107, 903, 103; 493/187, 189, 493/208; 426/118
See application file for complete search history.

(56) References Cited

U.S. PATENT DOCUMENTS

| | | | | |
|---|---|---|---|---|
| 3,370,780 A | | 2/1968 | Shaw | |
| 4,057,144 A | | 11/1977 | Schuster | |
| 5,399,022 A | * | 3/1995 | Sheets | 383/103 |
| 5,553,942 A | * | 9/1996 | Domke et al. | 383/101 |
| 5,655,842 A | * | 8/1997 | Hagino | 383/101 |
| 5,902,046 A | * | 5/1999 | Shibata | 383/107 |
| 6,170,985 B1 | * | 1/2001 | Shabram et al. | 383/100 |

FOREIGN PATENT DOCUMENTS

| | | | | |
|---|---|---|---|---|
| EP | 0 890 521 | | 1/1999 | |
| EP | 0 933 310 | | 8/1999 | |
| JP | 06001359 A | * | 1/1994 | 383/102 |

* cited by examiner

*Primary Examiner*—Robin A. Hylton
(74) *Attorney, Agent, or Firm*—Fildes & Outland, P.C.

(57) ABSTRACT

A storage bag is disclosed having a simple structure and capable of discharging gas generated by contents and capable of preventing the contents from leaking. In the storage bag closed by heat sealing, a pressure sensitive adhesive is previously applied to an arbitrary heat portion. The portion applied with the pressure sensitive adhesive is heat sealed in a state in which the portion is divided, and a gas venting air passage is formed as a non-heat seal portion in an intermediate portion of the heat sealed portion.

12 Claims, 14 Drawing Sheets

GAS VENTING STORAGE BAG

BACKGROUND OF THE INVENTION

1. Field of the Invention

The present invention relates to a storage bag for storing fermented foods such as coffee beans (including ground coffee beans) and soybean pastes (miso), ferment, bleaching agent and the like, such that gas generated by such contents can be discharged.

2. Related Art

As a storage bag for storing fermented foods such as coffee beans and soybean pastes, a storage bag provided with a gas vent for discharging gas is conventionally known.

When the contents are coffee beans, the storage bag may be provided with a gas vent for discharging gas which is smaller than coffee beans, but if the contents are soybean pastes, in order to prevent the soybean pastes from leaking, a position of the storage bag where the gas vent for discharging gas is provided is limited. Therefore, when the contents are soybean pastes, there is a problem that the gas vent for discharging gas must be provided in an upper end of the storage bag, and the storage bag must be in storage on display in a state in which the storage bag is in an upright position.

Hence, in order to solve such a problem, the present assignee proposes a storage bag as disclosed in Publication of Japanese Unexamined Patent Application No. 11-1243 for example.

According to the storage bag disclosed in this publication, the storage bag body stores contents which breathes and generates gas, and an air passage is formed in a portion of the storage bag body. A film layer made of synthetic resin is provided on a position of the storage bag body corresponding to this air passage. A large number of particles made of material which is not melted at a melting point of the film layer are allowed to exist on the film layer in its thickness direction. An outer diameter of the particle is smaller than a thickness of the film layer. The film layer is drawn.

The film layer used for the storage bag having the above-described structure is formed with a large number of fine gaps directing substantially in the drawing direction such as to surround the particles. In an arbitrary position of the film layer, the large number of gaps are connected to each other such as to pass through the film layer in its thickness direction. If the contents breathes and generates gas and a pressure in the storage bag reaches a given pressure, gas is pushed and discharged from the large number of gaps which are connected in the thickness direction of the film layer and which are located on the air passage. By repeating this phenomenon, the storage bag can maintain its state in which the storage bag is expanded to such a degree that the storage bag is not ruptured. The fine gaps formed in the film layer have such size that the contents do not leak therethrough, and even if the storage bag is in an upright position or a horizontal position, the contents do not leak and gas can be discharged.

In the case of the storage bag disclosed in this Publication of Japanese Unexamined Patent Application No. 11-1243, however, on the film layer provided at the position of the air passage, a large number of particles made of material which is not melted at a melting point of the film layer and each having an outer diameter smaller than the thickness of the film layer exist in the thickness direction of the film layer. Such a film layer which is different from the material of the storage bag body must be prepared and the film layer must be mounted on the position of the storage bag body corresponding to the air passage, and there is a problem that the cost of the storage bag body is increased.

SUMMARY OF THE INVENTION

The present invention has been accomplished to solve such a problem, and it is an object of the invention to provide a storage bag having a simple structure and capable of discharging gas generated by contents and capable of preventing the contents from leaking, while deleting necessity of preparing the above-described film layer and of mounting the film layer on the storage bag body at a position corresponding to an air passage.

In a storage bag closed by heat sealing according to the present invention, a pressure sensitive adhesive is previously applied to an arbitrary heat seal portion, the portion of the heat seal portion applied with the pressure sensitive adhesive is heat sealed in a divided manner, and an intermediate portion of the heat seal portion is formed into a gas venting air passage as a non-heat seal portion.

In the storage bag according to the present invention, the heat seal portion is formed within a range of an application width of the pressure sensitive adhesive.

In the storage bag according to the present invention, the heat seal portion is formed astride a location within the range and a location without the range of an application width of the pressure sensitive adhesive.

In the storage bag according to the present invention, a vent sheet made of a nonwoven fabric sheet or the like is mounted on an inner surface of the storage bag in the vicinity of the heat seal portion where the gas venting air passage is formed, and gas in the storage bag is discharged out from the air passage through the vent sheet.

According to the structure described above, it is unnecessary to prepare a special film layer as described under the Related Art and to mount the film layer on the storage bag body at a position corresponding to the air passage. The pressure sensitive adhesive is previously applied to the arbitrary heat seal portion, the portion applied with the pressure sensitive adhesive is applied is heat sealed, and the intermediate portion of the heat seal portion is formed into a gas venting air passage as a non-heat sealed portion. With such a simple structure, it is possible to discharge gas generated by the contents and to prevent the contents from leaking. That is, the gas is discharged while the non-heat seal portion (air passage) is being pushed and spread, but when the gas vent is completed, the air passage is closed and the closed state is maintained by the pressure sensitive adhesive applied to the inner surface of the air passage. Thus, it is possible to prevent the contents from leaking and to prevent air from entering from outside into the storage bag, whereby the oxidation of the contents can be prevented. Since the vent sheet made of a nonwoven fabric sheet or the like is mounted on an inner surface of the storage bag in the vicinity of the heat seal portion where the gas vent air passage is formed, it is possible to reliably prevent powdery contents from leaking.

DESCRIPTION OF THE PREFERRED EMBODIMENTS

Figure 1:
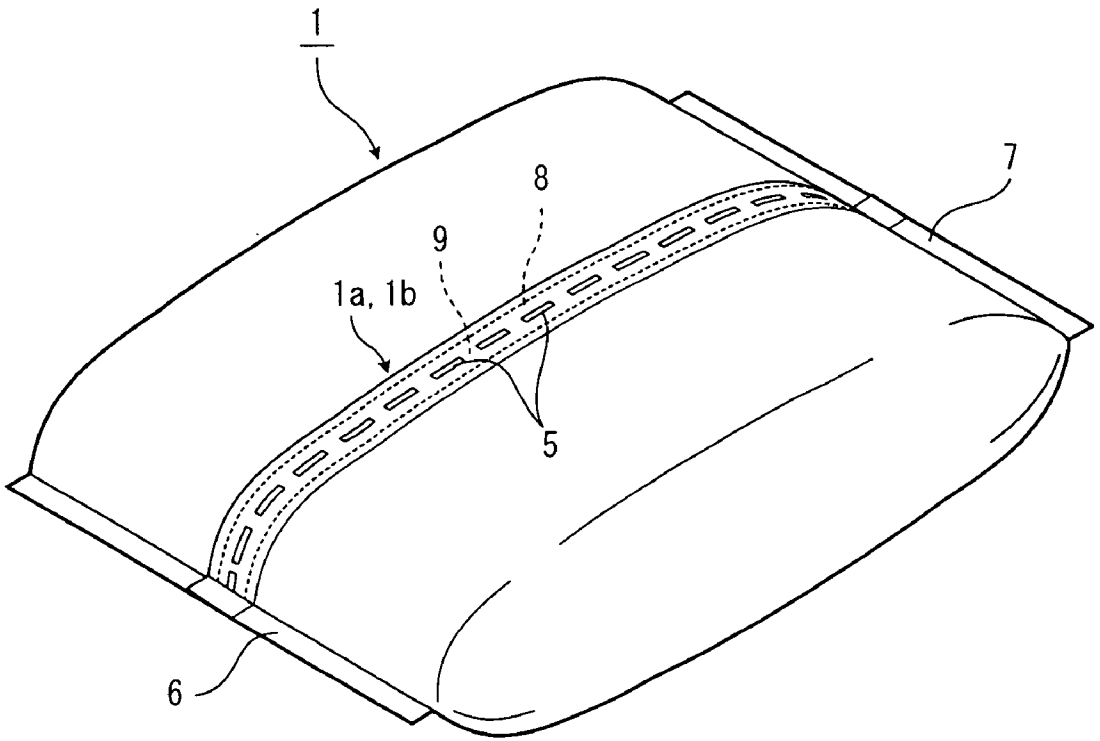
FIG. 1 is a perspective view of a storage bag according to a first embodiment of the present invention.
Figure 2:
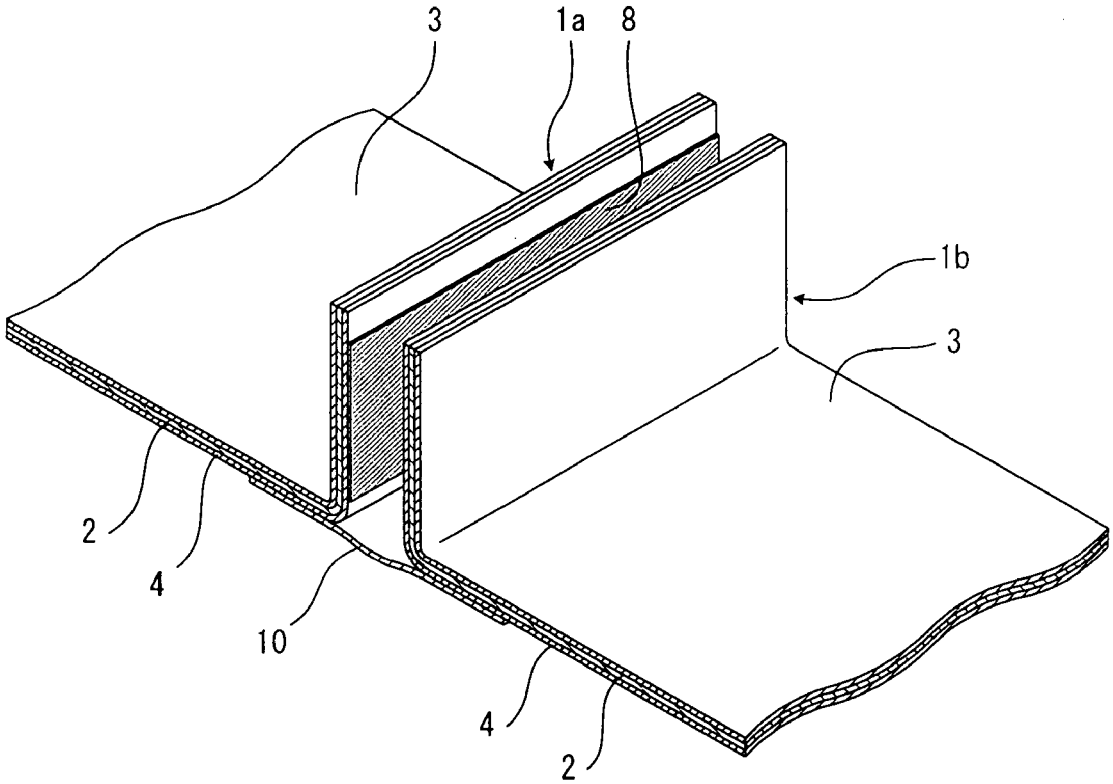
FIG. 2 is a perspective view showing a state in which ends of film layers forming the packaging bag have not yet been heat sealed in a face-to-face manner.
Figure 3:
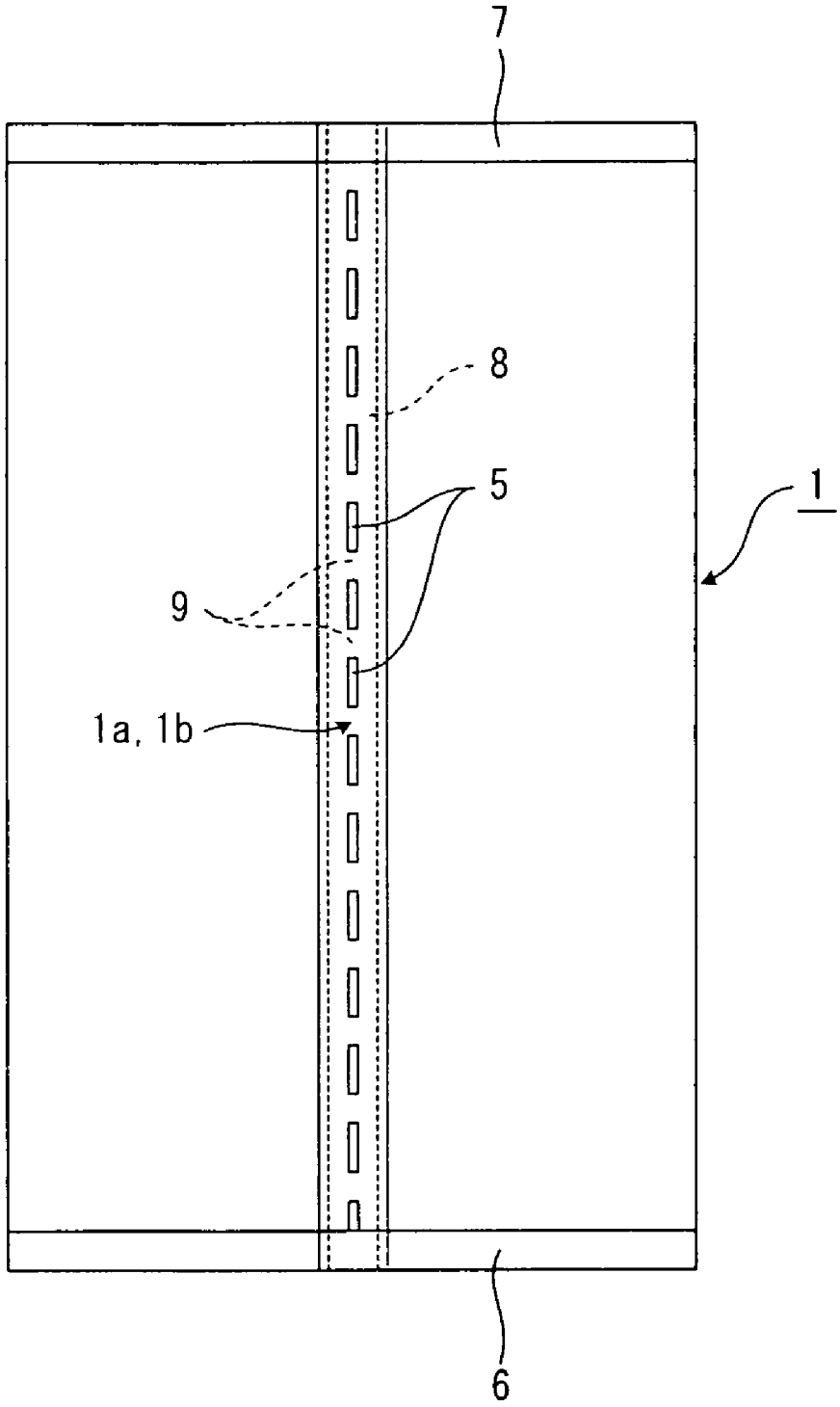
FIG. 3 is a rear view of the storage bag.
Figure 4:
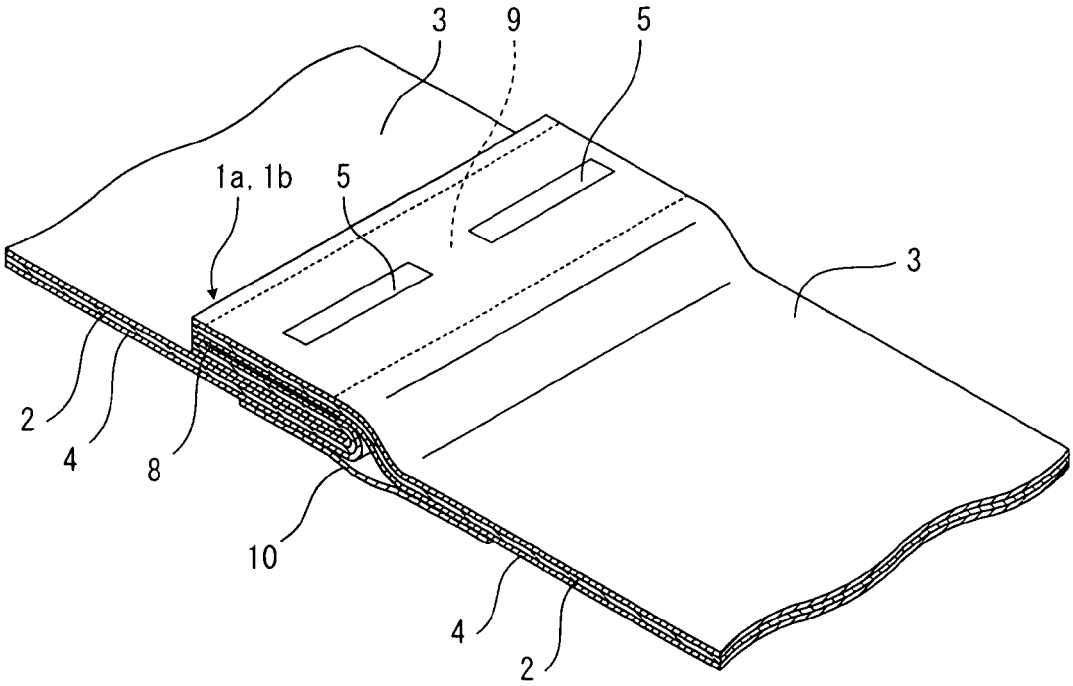
FIG. 4 is an enlarged sectional perspective view of an essential portion of the storage bag.
Figure 5:
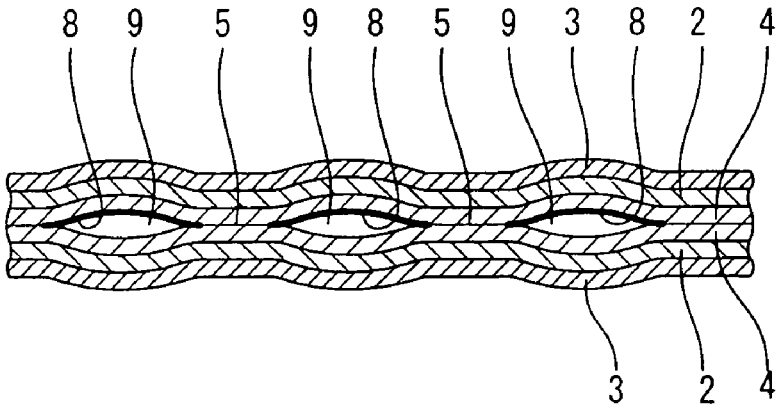
FIG. 5 is an enlarged sectional view of the essential portion of the packaging bag showing a state in which air passages are open.
Figure 6:
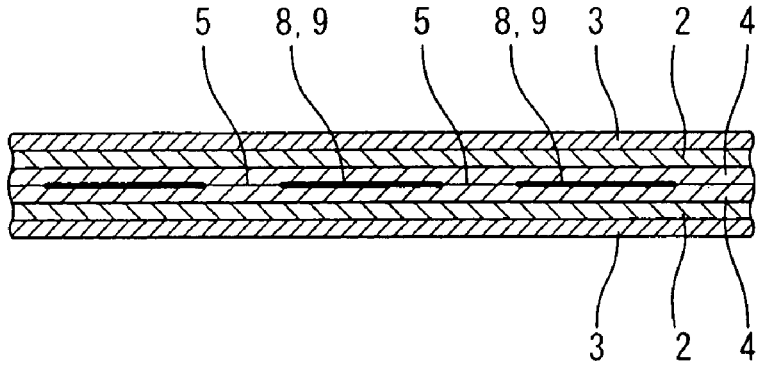
FIG. 6 is an enlarged sectional view of the essential portion of the storage bag showing a state in which the air passages are closed.

FIGS. 1 to 6 show a first embodiment of the present invention.

In FIGS. 1 to 6, a reference symbol 1 represents a storage bag body. The storage bag body 1 is formed by laminating and joining, on one another, an inner film layer 4 made of polyethylene, an intermediate coating layer 2 made of vinylidene chloride, and an outer film layer 3 made of polyethylene terephthalate, nylon or polypropylene, so that the storage bag body is provided with a barrier function to prevent oxidation thereof. The storage bag body 1 is thus formed with one sheet of raw material having the above-described configuration, which is curved into a cylindrical shape, and ends 1*a* and 1*b* thereof are superposed on each other in a face-to-face manner, and are closed by heat sealing. A reference symbol 5 represents heat seal portions in a face-to-face manner. A reference symbol 6 represents a heat seal portion on one end of the storage bag body 1, which intersects with the heat seal portions 5. A reference symbol 7 represents a heat seal portion on the other end of the storage bag body 1, which is in parallel to the heat seal portion 6 and is closed after contents are charged into the storage bag body 1.

In the storage bag having such a structure of this embodiment, a cold seal agent 8, for example, as a pressure sensitive adhesive (so-called adhesive) is previously applied to heat seal surfaces which are inner surfaces of the ends 1*a* and 1*b* along a longitudinal direction of the heat seal portions 5 joined to each other in the face-to-face manner. A main component of the cold seal agent 8 is natural rubber latex or synthetic rubber butadiene. In the case of the natural rubber latex, it is dissolved in an aromatic solvent and formed into a cold seal agent. In the case of synthetic rubber butadiene, it is emulsified and formed into a water base emulsion.

The cold seal agent 8 is applied in a belt shape to the inner surface of at least one of the ends 1*a* and 1*b*. The ends 1*a* and 1*b* sandwich therebetween the cold seal agent 8, and are heat sealed at intervals of an appropriate distance. The heat seal portions 5 are formed in broken line forms. A non-heat seal portion located between adjacent heat seal portions 5 becomes an air passage 9. In the embodiment illustrated in the FIGS. 1 to 6, the ends 1*a* and 1*b* are heat sealed in a row of a broken-line in the longitudinal direction of the inner surfaces of the ends 1*a* and 1*b* applied with the belt-shaped cold seal agent 8, along the widthwise central portion of the belt-shaped cold seal agent 8. A reference symbol 10 represents a long-fiber nonwoven fabric sheet mounted on the inner surface of the storage bag body 1 at the joined portion of the ends 1*a* and 1*b* in the face-to-face manner.

This storage bag body 1 is provided to store contents such as coffee beans or soybean pastes that generate gas by breathing.

In the above structure, as the contents that generate gas by breathing in the storage bag, coffee beans are in storage on display. In this state, if the coffee beans breathe and generate gas, a pressure in the storage bag gradually increases and the storage bag expands. If the pressure in the storage bag reaches a given pressure, the ends 1*a* and 1*b* are spread open against adhesive force of the cold seal agent 8 at the air passage (non-heat seal portion) 9 existing between the heat seal portions 5 of the joined ends 1*a* and 1*b*, whereby the air passage 9 is forced to open, and the gas in the storage bag is pushed out and discharged. If the pressure in the storage bag is lowered than the given pressure, the expansion between the ends 1*a* and 1*b* is returned to its original state at the air passage (non-heat seal portion) 9, whereby the air passage 9 is closed by the adhesion force of the cold seal agent 8, air is prevented from entering from outside into the storage bag, and the oxidation of the contents is prevented. By repeating this operation, the storage bag can maintain its state of expansion having such a degree that does not rupture the storage bag. Even if the storage bag is in an upright position or a horizontal position, the contents do not leak and gas can be discharged. In this embodiment, the long-fiber nonwoven fabric sheet 10 is mounted on the inner surface of the storage bag body 1 at the joined portion of ends 1*a* and 1*b*. When the contents include powder or the like which is prone to leak, the long-fiber nonwoven fabric sheet 10 is provided to prevent the contents from leaking. The need for provision of the long-fiber nonwoven fabric sheet 10 depends upon the size and kind of the contents. It is also possible to use a film sheet having small vent holes instead of the long-fiber nonwoven fabric sheet 10. Examples of the contents stored in the storage bag include a chloric bleaching agent or the like which reacts with moisture in air to generate hydrogen gas, in addition to the coffee beans and soybean pastes which breathe and generate gas.

The adhesion force on the inner surface of the air passage (non-heat seal portion) 9 generated by applying the cold seal agent 8 differs depending on whether the cold seal agent 8 is applied to one of the surfaces of the ends 1*a* and 1*b* or to both of the surfaces of the ends 1*a* and 1*b*. Although the adhesion force differs depending on the application thickness of the cold seal agent 8, when the cold seal agent 8 is applied to one of the surfaces, the adhesion force is in a range of 0.001N/25 mm to 0.3N/25 mm, and when the cold seal agent 8 is applied to both of the surfaces, the adhesion force is in a range of 0.01N/25 mm to 9.0N/25 mm. A preferable adhesion force is in a range of 0.001N/25 mm to 0.3N/25 mm.

Figure 7:
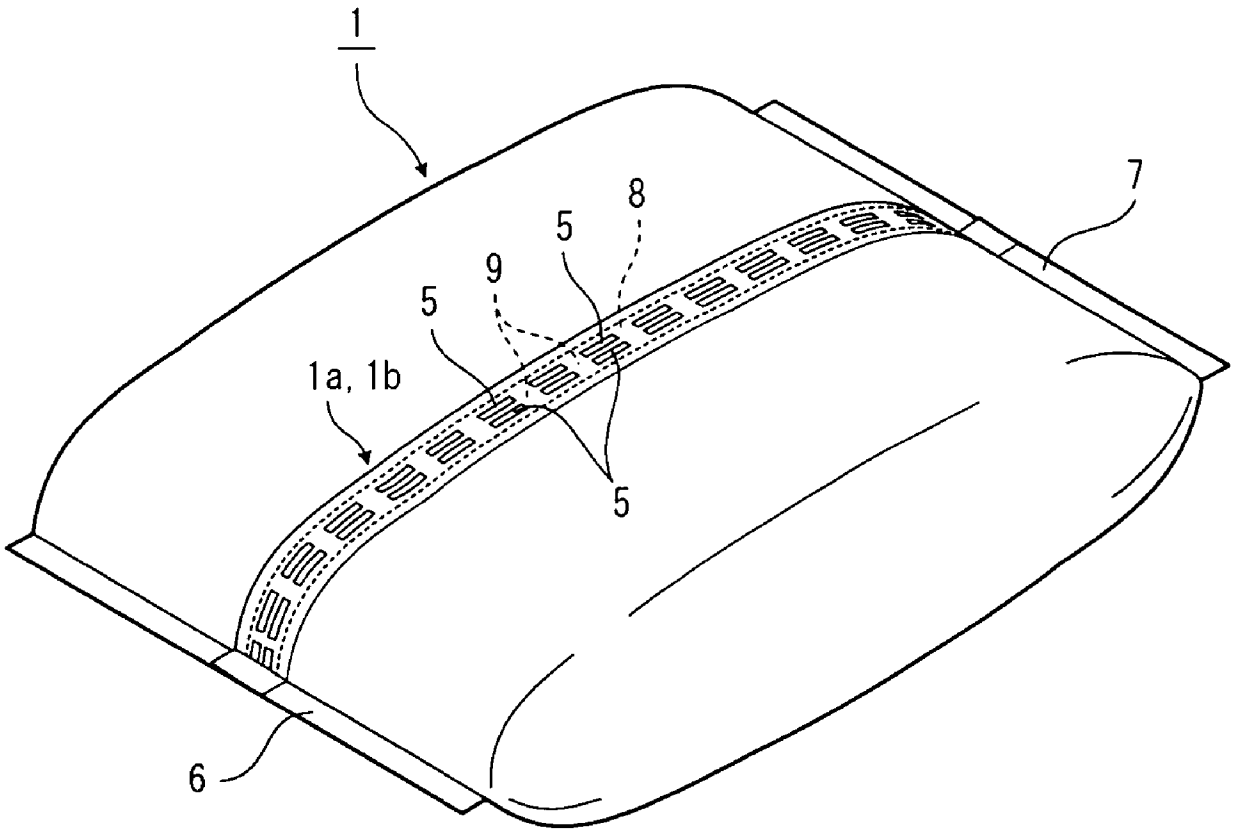
FIG. 7 is a perspective view of a storage bag according to a second embodiment of the invention.
Figure 8:
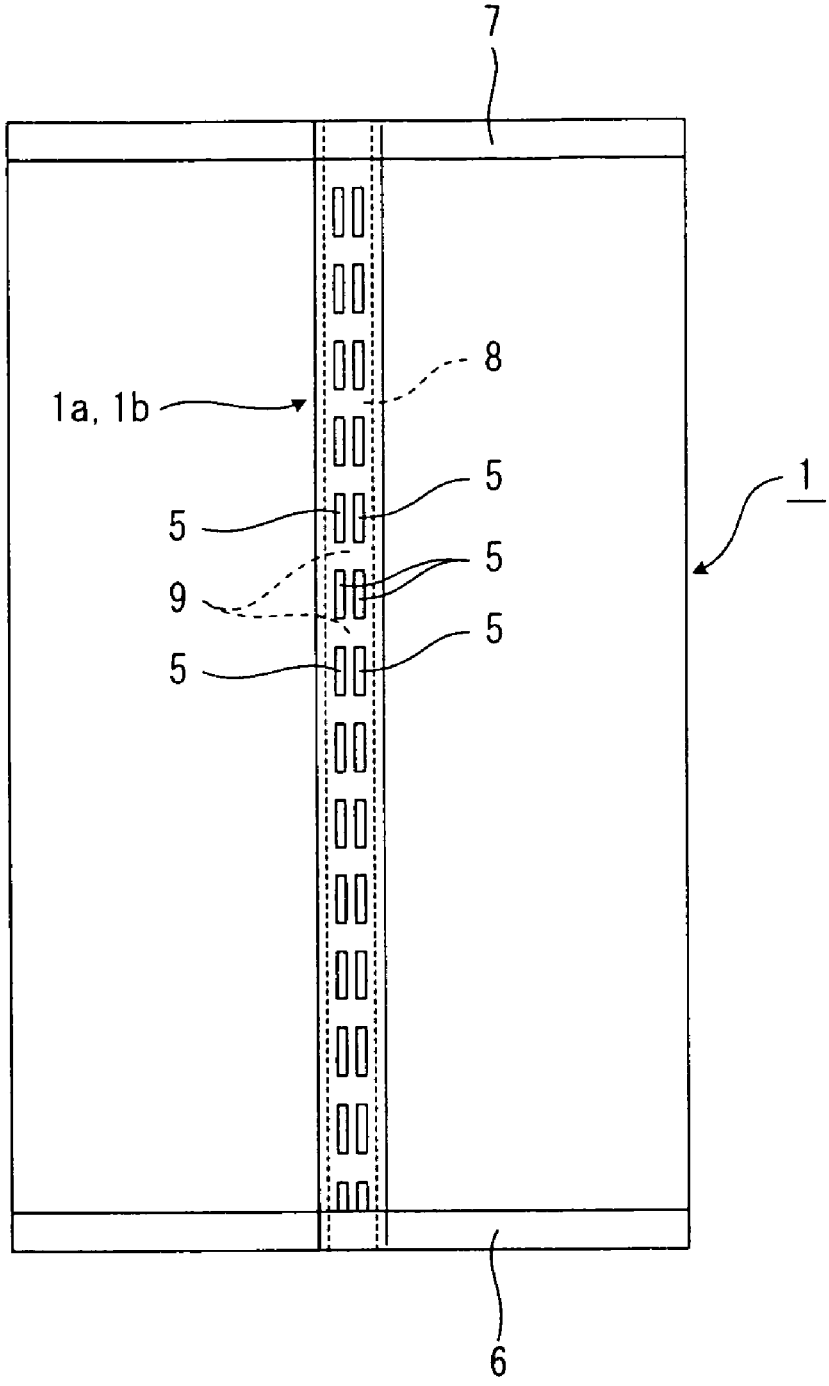
FIG. 8 is a rear view of the storage bag.
Figure 9:
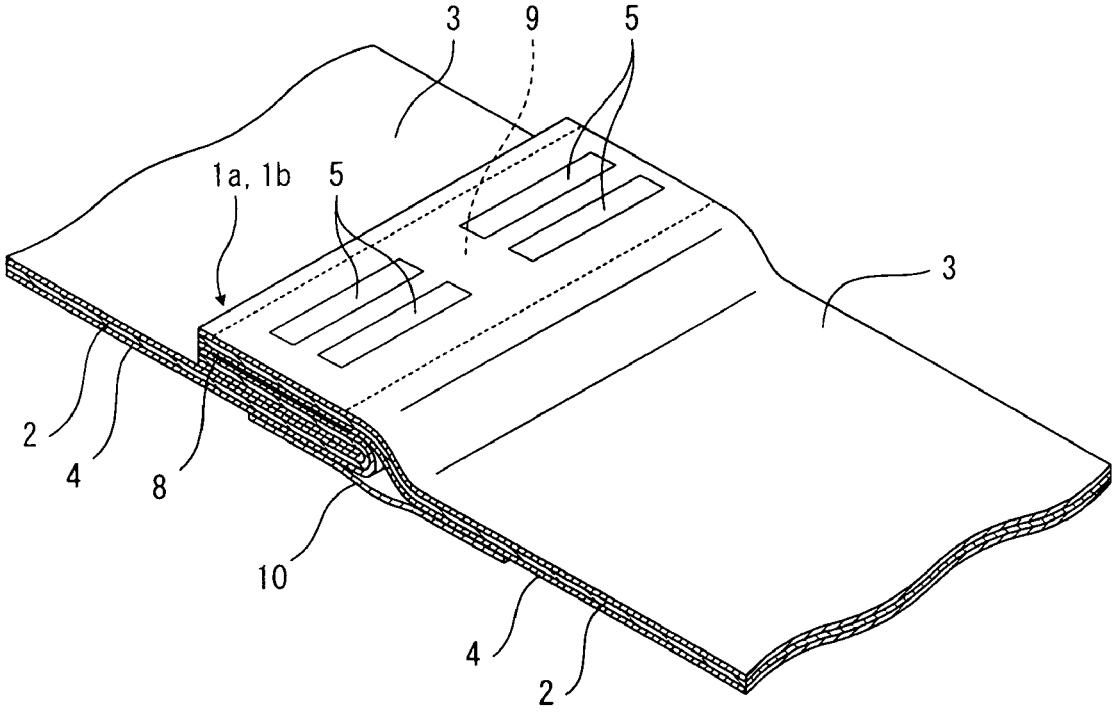
FIG. 9 is an enlarged sectional perspective view of an essential portion of the storage bag.

FIGS. 7 to 9 show a second embodiment of the present invention.

The second embodiment will be explained with reference to FIGS. 7 to 9. In the first embodiment, the ends 1*a* and 1*b* are heat sealed in a row of a single broken line along the widthwise central portion of the inner surfaces of the ends 1*a* and 1*b* applied with the belt-shaped cold seal agent 8. In the second embodiment, the ends 1*a* and 1*b* are heat sealed in two rows of broken lines along widthwise opposite ends of the inner surfaces of the ends 1*a* and 1*b* applied with the belt-shaped cold seal agent 8. With this structure, the cold seal agent 8 exists also between the two rows of heat seal portions 5 and 5, and when gas passes through the air passage (non-heat seal portion) 9, the adhesion force increases.

Figure 10:
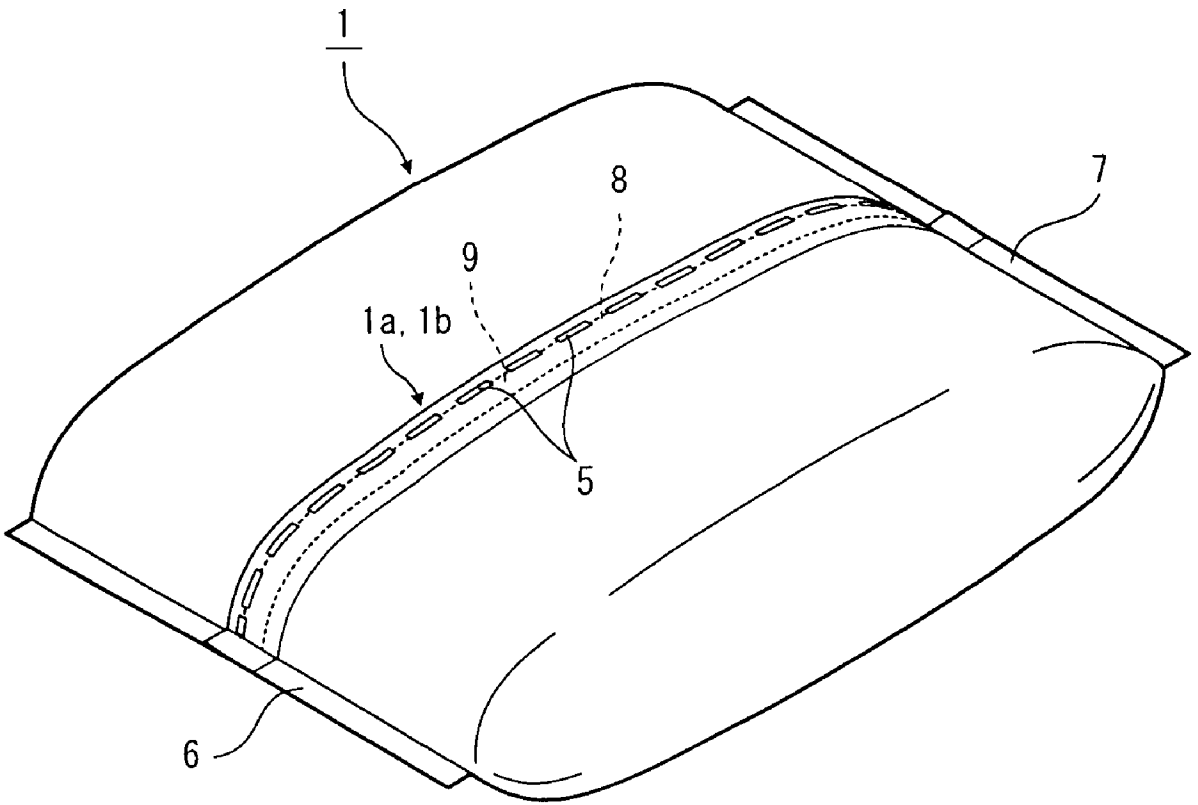
FIG. 10 is a perspective view of a storage bag according to a third embodiment of the invention.
Figure 11:
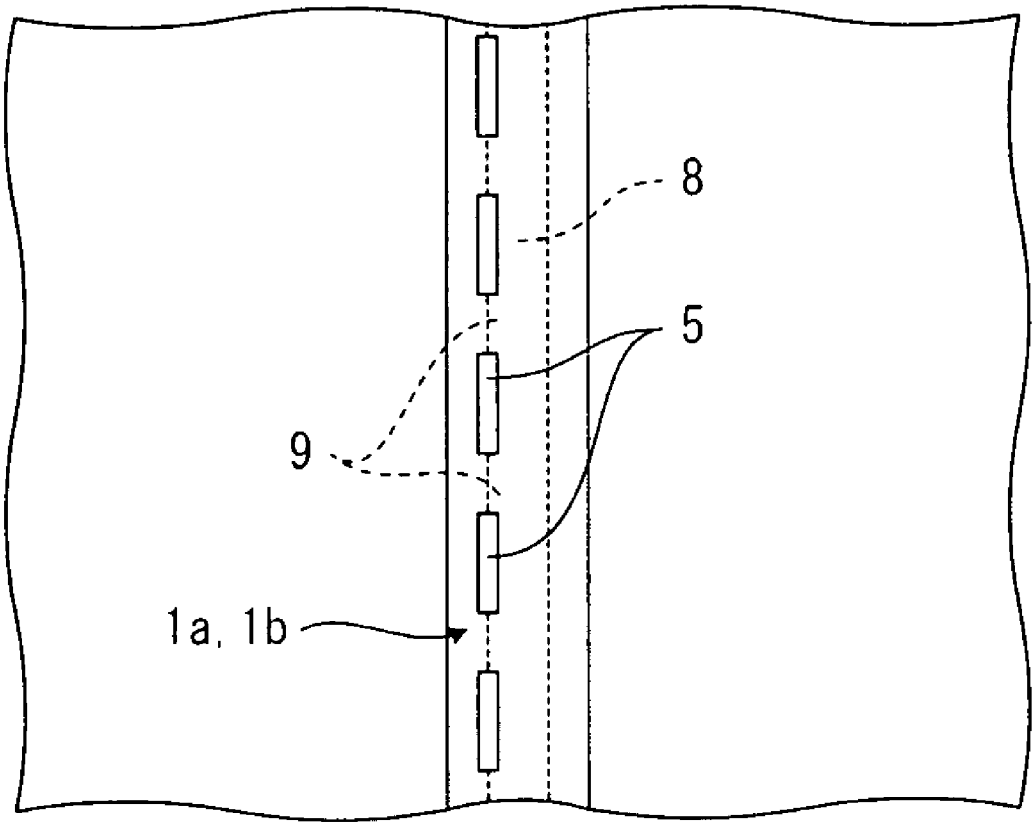
FIG. 11 is an enlarged rear view of an essential portion of the storage bag.
Figure 12:
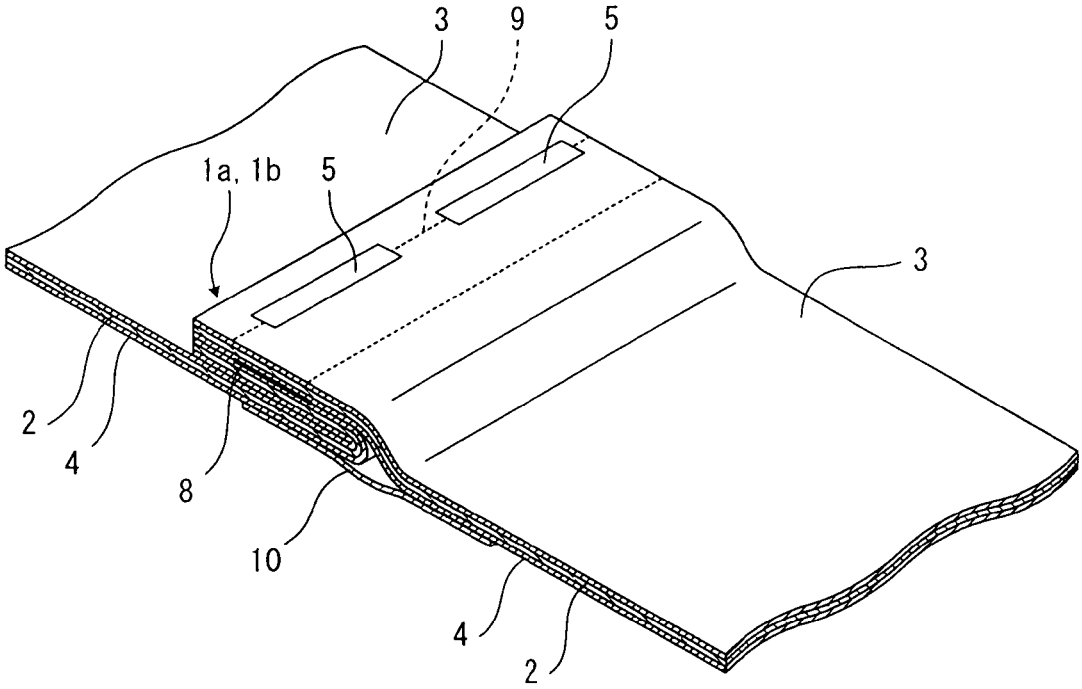
FIG. 12 is an enlarged sectional perspective view of the essential portion of the storage bag.

FIGS. 10 to 12 show a third embodiment of the present invention.

The third embodiment will be explained with reference to FIGS. 10 to 12. Although the heat seal portions 5 are formed within a range of the width of the cold seal agent 8 in the above two embodiments, the heat seal portions 5 may be formed astride a location within the range and a location without the range of the application width of the cold seal agent 8 as in the third embodiment. More specifically, the heat seal portions 5 are formed on the end side of the application width of the cold seal agent 8, which is closer to the end faces of the face-to-face superposed ends 1*a* and 1*b*.

Figure 13:
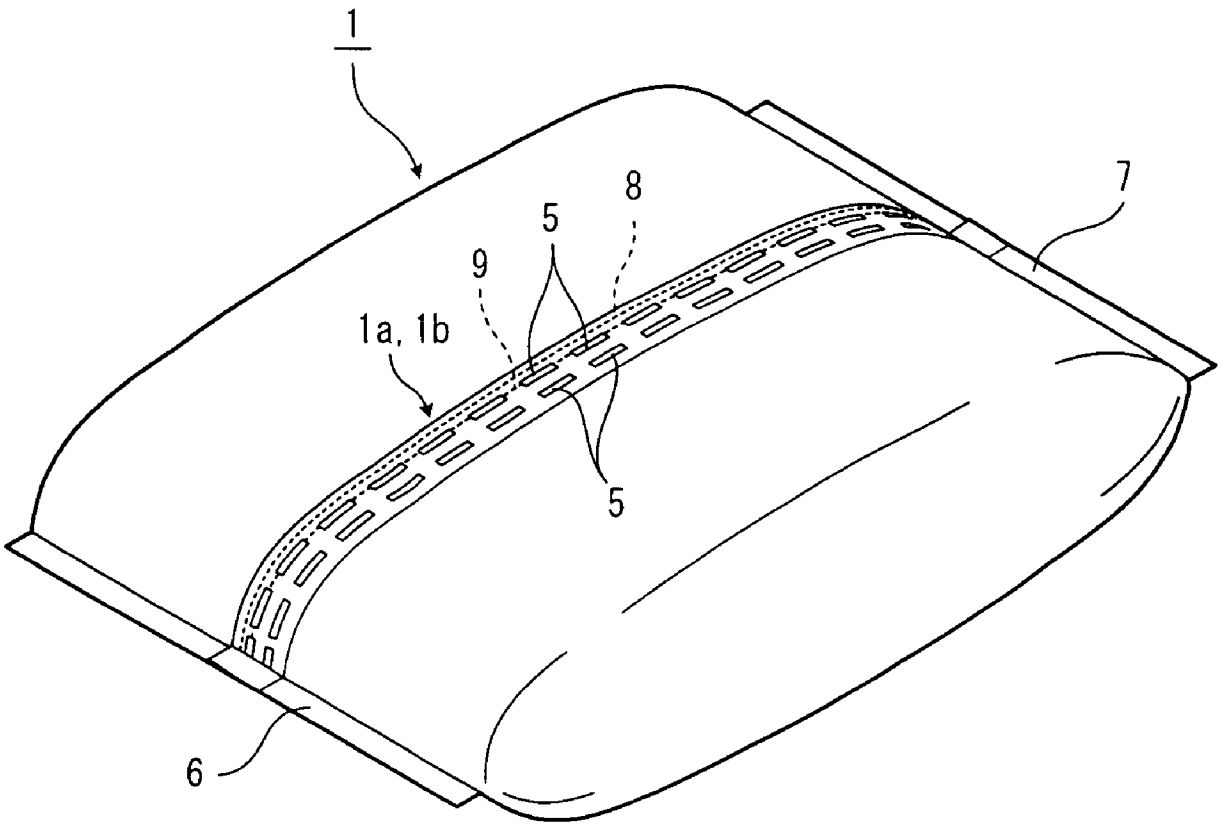
FIG. 13 is a perspective view of a storage bag according to a fourth embodiment of the invention.
Figure 14:
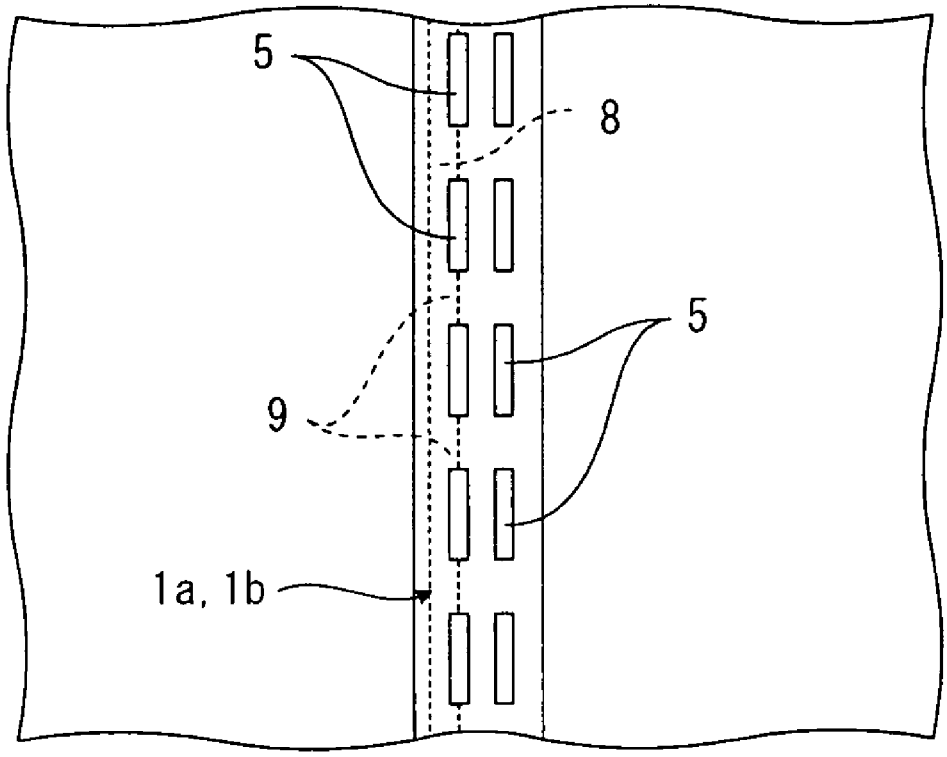
FIG. 14 is an enlarged rear view of an essential portion of the storage bag.
Figure 15:
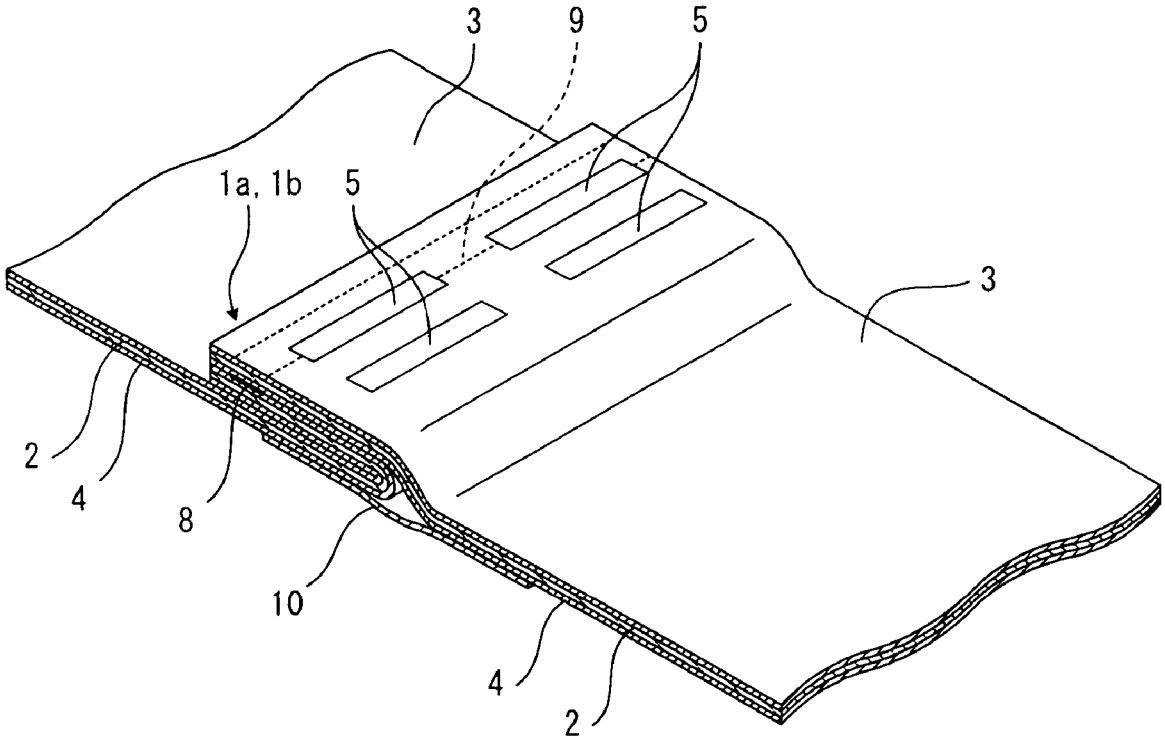
FIG. 15 is an enlarged sectional perspective view of the essential portion of the storage bag.

FIGS. 13 to 15 show a fourth embodiment of the present invention.

The fourth embodiment will be explained with reference to FIGS. 13 to 15. In the fourth embodiment, the heat seal portions 5 and 5 are formed in two rows of broken lines as in the second embodiment. However, the cold seal agent 8 is not applied to one the two rows of the heat seal portions 5, which is closer to a bent portion of the face-to-face superposed ends 1*a* and 1*b* with respect to the storage bag body 1. The cold seal agent 8 is applied only to the other of the two rows of heat seal portions 5. The heat seal portions 5 of the other row are formed astride a location within the range and a location without the range of the application width of the cold seal agent 8, along an end of the application width of the cold seal agent 8 which is opposite to an end closer to the end faces of the face-to-face superposed ends 1*a* and 1*b*.

Although the storage bag body 1 is formed in the face-to-face state in the above four embodiments, the form of the storage bag body 1 is not limited to this only. An all-sides seal type, a gazette type or stand back type storage bag body may be employed. In short, the cold seal agent may be applied to an inner surface of an appropriate heat seal portion, and the air passage (non-heat seal portion) for venting gas may be formed in an intermediate portion between the heat seal portions formed within the range of the applied cold seal agent.

Although the cold seal agent 8 is used as the pressure sensitive adhesive (so-called adhesive) in the above four embodiments, another adhesive may be used.

In the storage bag body 1 in each of the above four embodiments, if the inner film layer is made of a synthetic film such as a polyethylene film or a polypropylene film to meet with the need of heat sealing, there is no special limitation to a material to be laminated on the film layer.

Although the heat seal portions 5 are formed in the broken line form and the air passage (non-heat seal portion) 9 is formed between the adjacent heat seal portions 5 and 5 in the above four embodiments, there is no limitation to the shape of the heat seal portion.

What is claimed is:

1. A storage bag having a heat seal portion, a pressure sensitive adhesive applied to the heat seal portion, the heat seal portion being heat sealed in a divided manner, and a non-heat seal portion defined by an intermediate portion in the heat seal portion forming a gas venting air passage, wherein the heat seal portion is formed astride a location within a range of an application width of the pressure sensitive adhesive and a location outside of the range.

2. The storage bag according to claim 1, having a storage bag body having ends superposed on each other in a face-to-face manner.

3. The storage bag according to claim 1, having a vent sheet formed of a nonwoven fabric sheet mounted on an inner surface of the storage bag in the vicinity of the heat seal portion where the gas venting air passage is formed.

4. A storage bag having a heat seal portion, a pressure sensitive adhesive applied to the heat seal portion, the heat seal portion being heat sealed in a divided manner, and a non-heat seal portion defined by an intermediate portion in the heat seal portion forming a gas venting air passage, wherein the heat seal portion is formed in two rows of broken lines, and one of the two rows of the heat seal portion does not have the pressure sensitive adhesive applied thereto, while the other of the two rows does have the pressure sensitive adhesive applied thereto.

5. The storage bag according to claim 4, wherein the other of the two rows of the heat seal portion is formed astride a location within a range of an application width of the pressure sensitive adhesive and a location outside of the range.

6. The storage bag according to claim 4, having a storage bag body having ends superposed on each other in a face-to-face manner.

7. The storage bag according to claim 4, having a vent sheet formed of a nonwoven fabric sheet mounted on an inner surface of the storage bag in the vicinity of the heat seal portion where the gas venting air passage is formed.

8. A storage bag comprising:

a storage bag body having ends superposed on each other;

a row of a single broken line of heat seals, the heat seals defining heat seal portions and joining the superposed ends along a longitudinal direction of the superposed ends;

a pressure sensitive adhesive applied to the heat seal portions along a longitudinal direction of the heat seal portions, the pressure sensitive adhesive being sandwiched between the superposed ends of the storage bag body; and non-heat seal portions disposed between adjacent heat seal portions, each non-heat seal portion forming a gas venting air passage;

the heat seal portions being formed astride a location within a range of an application width of the pressure sensitive adhesive and a location outside of the range.

9. The storage bag according to claim 8, wherein the ends of the storage bag body are superposed on each other in a face-to-face manner.

10. The storage bag according to claim 8, wherein a vent sheet formed of a nonwoven fabric sheet is mounted on an inner surface of the storage bag body adjacent the superposed ends in the vicinity of the heat seal portions where the gas venting air passages are formed.

11. The storage bag according to claim 8, including a second row of a broken line of heat seals defining heat seal portions along a longitudinal direction of the superposed ends, the second row of heat seal portions not having a pressure sensitive adhesive applied thereto.

12. The storage bag according to claim 11, wherein the ends of the storage bag body are superposed on each other in a face-to-face manner, and the second row of heat seal portions is closer to a bent portion of the face-to-face superposed ends than the row of heat seal portions having the pressure sensitive adhesive applied thereto.

* * * * *